US006517359B1

(12) United States Patent
Felps et al.

(10) Patent No.: US 6,517,359 B1
(45) Date of Patent: Feb. 11, 2003

(54) SYSTEM AND METHOD FOR MATING ELECTRICAL CONNECTIONS

(75) Inventors: Jimmie D. Felps, Colorado Springs, CO (US); David Nelson Kimbley, Colorado Springs, CO (US); Brett B. Bamesberger, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/595,986

(22) Filed: Jun. 16, 2000

Related U.S. Application Data

(63) Continuation of application No. 09/316,228, filed on May 21, 1999, now abandoned.

(51) Int. Cl.[7] ..... H01R 12/00

(52) U.S. Cl. ..... 439/63; 439/581; 439/246; 439/289; 439/314; 439/722; 439/736

(58) Field of Search ..... 439/63, 78, 314, 439/581, 290, 660, 722, 733.1, 289, 736, 876, 246, 247; 29/874, 829, 837, 882

(56) References Cited

U.S. PATENT DOCUMENTS

| | | | | |
|---|---|---|---|---|
| 2,369,860 A | | 2/1945 | Schroeder | 173/328 |
| 3,810,258 A | * | 5/1974 | Mathauser | 439/246 |
| 3,994,552 A | | 11/1976 | Selvin | 339/49 B |
| 4,083,619 A | | 4/1978 | McCormick et al. | 339/75 M |
| 4,423,373 A | | 12/1983 | LeCroy, Jr. | 324/72.5 |
| 4,672,306 A | | 6/1987 | Thong | 324/72.5 |
| 4,708,661 A | | 11/1987 | Morland et al. | 439/77 |
| 4,734,050 A | | 3/1988 | Negre et al. | 439/289 |
| 5,015,947 A | | 5/1991 | Chism | 324/158 P |
| 5,214,308 A | | 5/1993 | Nishiguchi et al. | 257/692 |
| 5,293,122 A | | 3/1994 | Cake et al. | 324/158 P |
| 5,431,580 A | | 7/1995 | Tabata | 439/289 |
| 5,460,536 A | | 10/1995 | Cullen | 439/289 |
| 5,857,866 A | | 1/1999 | Felps | 439/289 |
| 5,961,349 A | | 10/1999 | Paagman | 439/607 |

OTHER PUBLICATIONS

Philips Semiconductors "12C Bus specification" RF Communications Products, Dec. 1988, pp. 895, 897–921.
Tajimi, BNCS series, "One Touch Push/Pull Locking BNC Coaxial RF Connector (50 /75 )/BNCS Series" (undatad).
Tajimi electronic Co., Ltd., Data Sheet for BNCS502–P().
Stonewalls Corporation, Data Sheet for BNCS502–P () (undated).

* cited by examiner

*Primary Examiner*—Tho D. Ta

(57) ABSTRACT

An electrical connection system, such as a Bayonet Niel-Concelman (BNC) connection system, includes two connector assemblies and enables electrical connections between the two connector assemblies to be established and maintained. The two connector assemblies respectively include a first connector and a second connector. One of the connector assemblies includes a contact pin, and the other connector assembly includes a mechanical support having a tapered recess. The first connector interlocks with the second connector, and the contact pin is received by the recess and engages the mechanical support, when the first and second connectors are interlocked. Because the recess is tapered, the contact pin is guided toward the center of the recess as the contact pin is pressed against the surface of the mechanical support exposed by the recess, making it easier to establish and maintain an electrical connection with the contact pin.

20 Claims, 8 Drawing Sheets

SYSTEM AND METHOD FOR MATING ELECTRICAL CONNECTIONS

This is a continuation of application Ser. No. 09/316,228 filed May 21, 1999, now abandoned.

BACKGROUND OF THE INVENTION

1. Field of the Invention

The present invention generally relates to electrical connections and, in particular, to a system and method for establishing and maintaining a removable connection between an electrical conductor of a first connector assembly and a contact pin of a second connector assembly.

2. Related Art

Various kinds of electrical connectors exist and have been used for decades to provide a removable electrical connection between various types of electrical components and devices. One such kind of removable electrical connector is known as a BNC or Bayonet Niel-Concelman connector. BNC connectors were developed many years ago and are typically used to connect coaxial (i.e., two conductor) cables, frequently in low-power, radio-frequency, and test applications, although they may be used in other applications as well.

FIG. 1 shows a typical female connector 11 and a typical male BNC connector 13 that are designed to engage and disengage with one another. The connectors 11 and 13 are two-conductor connectors, with one of the conductors being a center conductor 23 (which mates with a female receptacle 21), and the other conductor being a center terminal 33 (which mates with a sleeve 15). In many applications, the second conductor, i.e., the center terminal 33 and the sleeve 15, are grounded, although that is not necessary. The sleeve 15 of the female connector 11 surrounds the female receptacle 21 and includes a pair of diametrically opposed engagement pins 17 and 19 that extend radially outward from the sleeve 15. The male connector 13 includes a male BNC center terminal 33 having a center conductor 23. The male connector 13 also includes a locking collar 29 having a pair of slots 25 and 27 that are adapted to engage the engagement pins 17 and 19 on the sleeve 15 of the female connector 11 to lock the connectors 11 and 13 together.

The female and male connectors 11 and 13 can be connected and locked together by first engaging the male BNC center terminal 33 with the sleeve 15 and then rotating the locking collar 29 to the locked position. This twist-lock coupling action is a central feature of the BNC connectors 11 and 13 and allows a reliable electrical connection to be made without the danger of the female and male connectors 11 and 13 gradually working loose or becoming accidentally unplugged.

Some male BNC connectors 13 are associated with additional contact pins (not shown by FIG. 1) that transmit signals in addition to the signals transmitted by center conductor 23 and center terminal 33. These additional contact pins connect to conductive pads (not shown in FIG. 1) associated with the female connector assembly 11. The conductive pads are usually formed on a flexible circuit (not shown) which transmits the signals received from the additional contact pins to other electrical devices.

However, the engagement pins 17 and 19 do not always keep the additional contact pins (not shown in FIG. 1) of the male BNC connector 13 precisely aligned with the conductive pads (not shown in FIG. 1) of the female BNC connector 11. Furthermore, the additional male contact pins of the male BNC connector 13 and the conductive pads of the female BNC connector 11 are not typically aligned when BNC connectors 11 and 13 first engage (i.e., before the engagement pins lock the BNC connectors 11 and 13 together). Therefore, it can be difficult to establish an electrical connection between the additional contact pins and the conductive pads.

Thus, a heretofore unaddressed need exists in the industry for providing a system and method of establishing and maintaining an electrical connection between a female connector assembly and the contact pins of a male connector assembly.

SUMMARY OF THE INVENTION

The present invention overcomes the inadequacies and deficiencies of the prior art as discussed hereinbefore. Generally, the present invention relates to a system and method for establishing and maintaining electrical connections between connector assemblies.

The present invention utilizes a mechanical support, a conductive connection, and an electrical connector. The mechanical support has a tapered recess and a wall defining the tapered recess. The conductive connection is electrically coupled to the wall, and the electrical connector is coupled to the mechanical support. Because the recess is tapered, a contact pin from a connector assembly is automatically guided toward a center of the recess when the contact pin is received by the recess. Accordingly, an electrical connection between the conductive connection and the contact pin is easily established and maintained.

The present invention can also be viewed as providing a method for establishing and maintaining electrical connections between connector assemblies. Briefly described, the method can be broadly conceptualized by the following steps: providing a first connector assembly having a first electrical connector and a conductive pin; providing a second connector assembly having a second electrical connector coupled to a mechanical support, the mechanical support having a tapered recess, the recess defined by a wall of the mechanical support; interlocking the first electrical connector with the second electrical connector; passing the contact pin into the recess; engaging the mechanical support with the contact pin; and sliding the contact pin along a surface of the wall.

Other features and advantages of the present invention will become apparent to one skilled in the art upon examination of the following detailed description, when read in conjunction with the accompanying drawings. It is intended that all such features and advantages be included herein within the scope of the present invention and protected by the claims.

BRIEF DESCRIPTION OF THE DRAWINGS

The invention can be better understood with reference to the following drawings. The elements of the drawings are not necessarily to scale relative to each other, emphasis instead being placed upon clearly illustrating the principles of the invention. Furthermore, like reference numerals designate corresponding parts throughout the several views.

DETAILED DESCRIPTION OF THE PREFERRED EMBODIMENT

Figure 1:
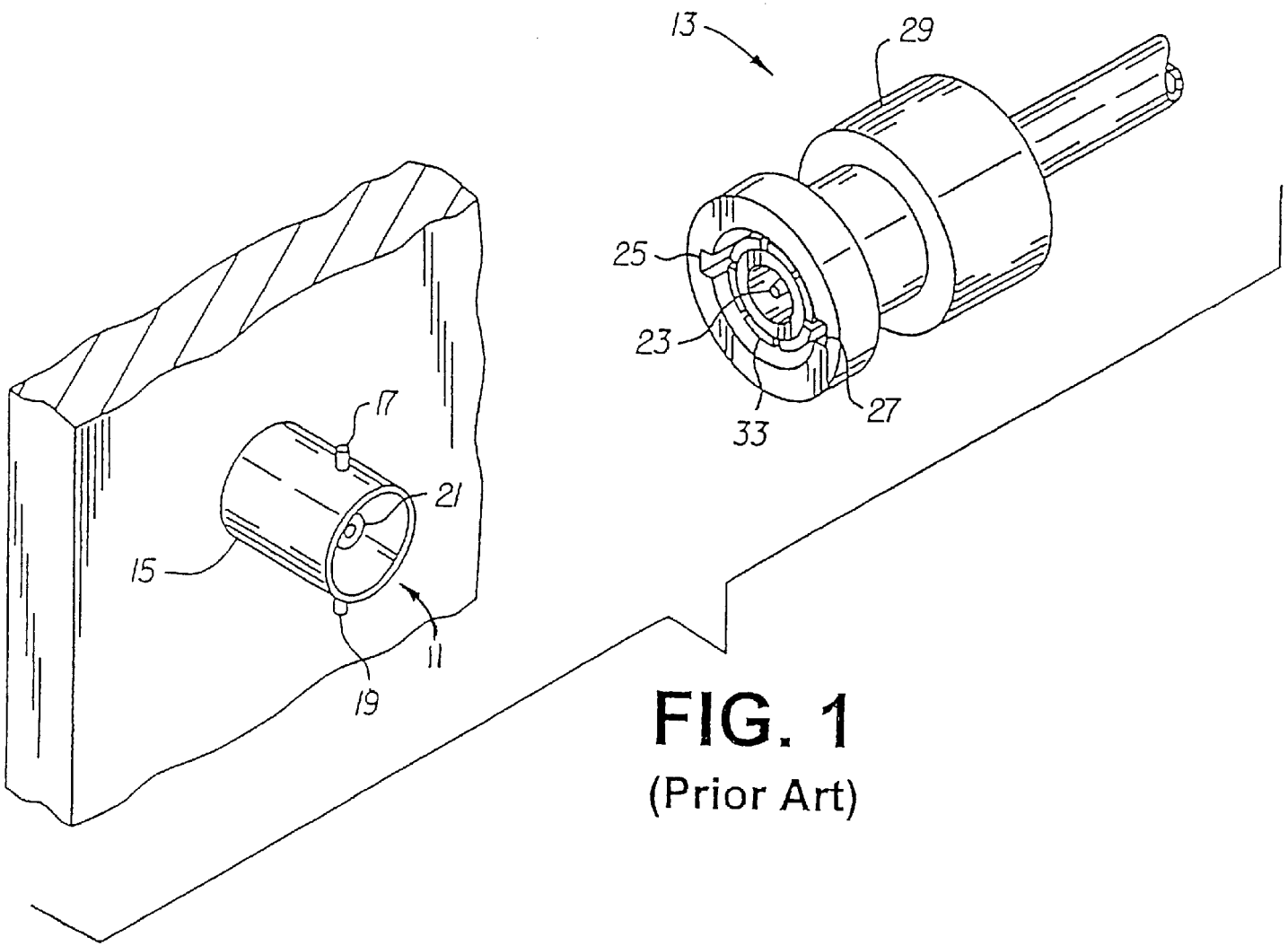
FIG. 1 (Prior Art)
FIG. 1 is a diagram illustrating a conventional Bayonet Niel-Concelman (BNC) connection system.
Figure 2:
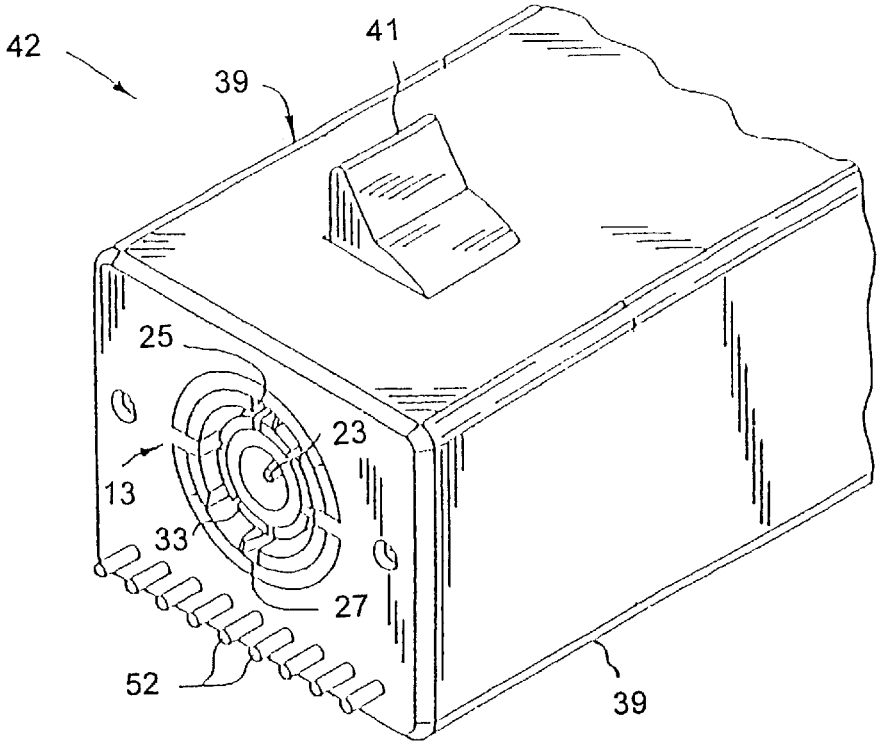
FIG. 2 is a diagram illustrating a male BNC connector assembly.
Figure 3:
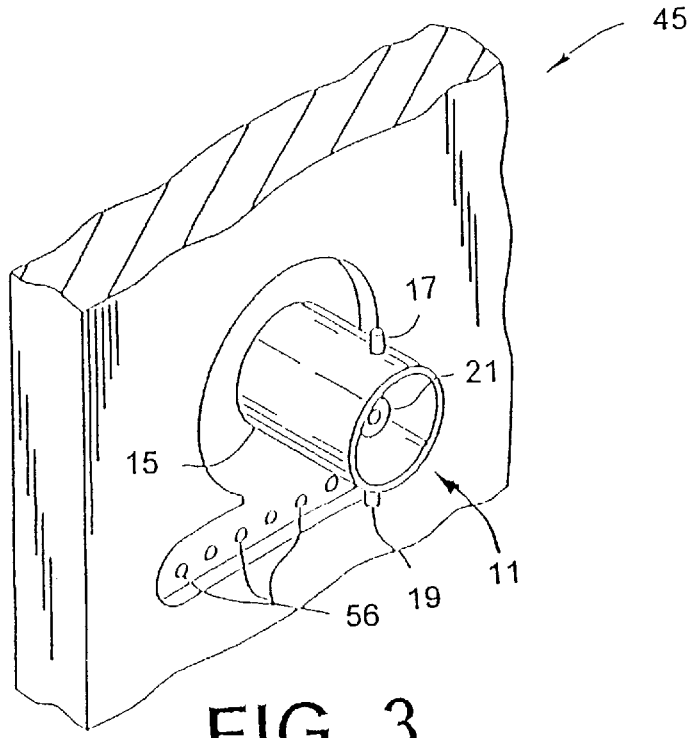
FIG. 3 is a diagram illustrating a female BNC connector assembly.

FIG. 2 depicts a male BNC assembly 42 that includes a male BNC connector 13 extending through a housing unit 39. The center conductor 23 and the center terminal 33 of the male connector 13 are exposed through a hole in the housing unit 39, as shown by FIG. 2. The assembly 42 also includes a tab 41 that is coupled to the locking collar 29 (FIG. 1). The tab 41 may be rotationally moved to lock or unlock the male BNC connector 13 with a female BNC connector 11 of a female BNC connector assembly 45 (FIG. 3). The female BNC connector 11 includes a sleeve 15, a female receptacle 21, and engagement pins 17 and 19. The connectors 11 and 13 may be connected and locked together by first engaging the male BNC terminal 33 with the sleeve 15 and then rotating the locking collar 29 via tab 41 to the locked position.

The male BNC connector assembly 42 also includes additional contact pins 52 for transmitting information additional to the information transmitted by center conductor 23 and center terminal 33. The female BNC connector assembly 45 includes conductive pads 56 for interfacing signals with contact pins 52. The pattern of the pads 56 preferably corresponds with the pattern of the contact pins 52 such that each contact pin 52 is engaged with a respective pad 56, when the connectors 11 and 13 are engaged and are in the locked position. The pads 56 are formed on a flexible printed circuit that routes the signals interfaced with the pads 56 from/to other devices. Exemplary designs for the assemblies 42 and 45 are fully described in U.S. Pat. No. 5,857,866, entitled "Supplemental Electrical Connector for Mating Connector Pair" and filed on Mar. 14, 1997, which is incorporated herein by reference.

Figure 4:
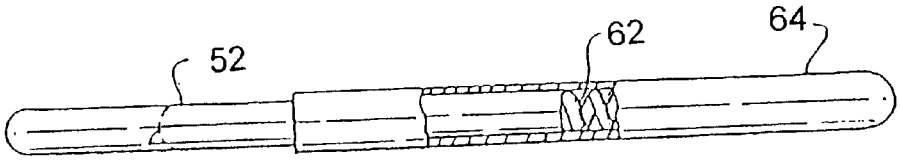
FIG. 4 is a diagram illustrating a more detailed view of a contact pin of the male BNC connector assembly of FIG. 2.

To ensure that each of the pins 52 is electrically connected to a respective pad 56, each of the pins 52 is spring loaded. In this regard, the end of each pin 52 opposite of pad 56 (when the pin 52 is engaged with the pad 56) is coupled to a spring 62, which is preferably housed within a sleeve 64, as shown by FIG. 4. Therefore, if any of the pins 52 engage one of the pads 56 before the other pins 52 engage the other pads 56, the spring 62 of the engaged pin 52 is compressed until the other pins 52 also engage the other pads 56.

A problem with the assemblies 42 and 45 is that precise rotational alignment between assemblies 42 and 45 is not guaranteed. Therefore, small variations in the rotational alignment may move some or all of the contact pins 52 out of alignment with their respective pads 56. In this regard, if the assembly 42 rotates relative to the assembly 45, some of the contact pins 52 may become separated from the pads 56. The further a pad 56 and its respective contact pin 52 are from the center of rotation (i.e., from the center of center conductor 23), the more sensitive is the alignment of the pad 56 and pin 52 to the rotational movements of the assembly 42 relative to the assembly 45. Although non-rotational alignment is not usually as significant of a problem as rotational alignment, any non-rotational movement between the assemblies 42 and 45 may also cause alignment problems between contact pins 52 and pads 56.

Furthermore, establishing an electrical connection between one of the contact pins 52 does not necessarily guarantee that electrical connections exist between the remaining contact pins 52 and pads 56. In this regard, the spring loaded design of the contact pins 52 allows the pins 52 to slightly move with respect to one another. Therefore, establishing an electrical connection with one of the contact pins 52 does not automatically establish and maintain an electrical connection with the remaining contact pins 52, even when the male connector 13 is interlocked with the female connector 11.

Figure 5A:
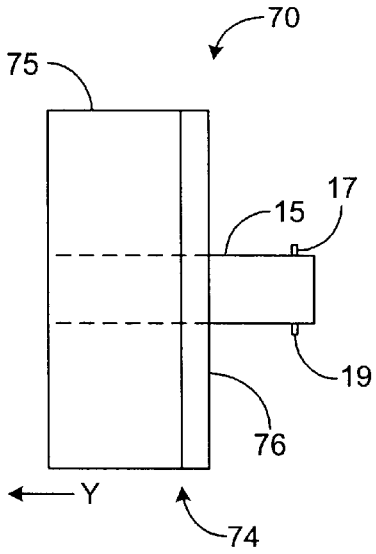
FIG. 5A is a diagram illustrating a side view of a female BNC connector assembly in accordance with the present invention.
Figure 5B:
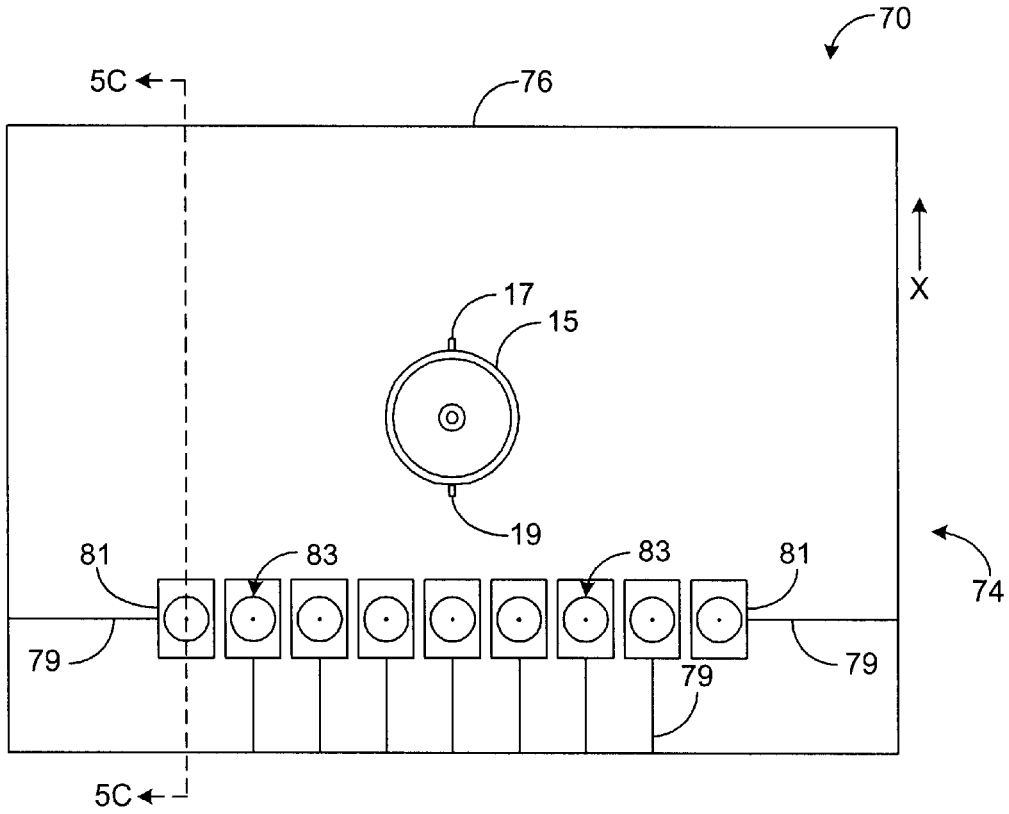
FIG. 5B is a diagram illustrating a front view of the female BNC connector assembly depicted by FIG. 5A.
Figure 5C:
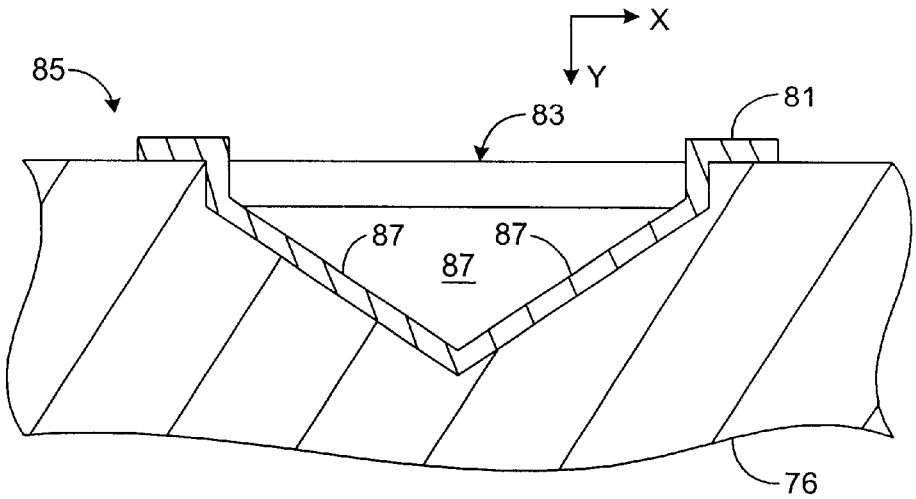
FIG. 5C is a cross-sectional diagram illustrating one of the tapered recesses shown by FIG. 5B.

FIGS. 5A–5C show an improved design for a female BNC connector assembly 70. The assembly 70 includes a mechanical support 74 which is coupled to and supports the sleeve 15. The mechanical support 74 may be comprised of multiple portions and/or layers. For example, in the preferred embodiment, the mechanical support 74 is comprised of a base 75 and a printed circuit board (PCB) 76. The base 75 may be a portion of an oscilloscope or other type of device, for example, and is preferably coupled to and supports the PCB 76. As shown by FIG. 5B, the PCB 76 preferably includes conductive connections 79 and conductive pads 81. Each of the conductive connections 79 shown in FIG. 5B is electrically coupled to a respective pad 81 at one end and to another device (not shown) at an opposite end and transmits electrical signals between the pad 81 and the other device.

As shown by FIGS. 5B and 5C, the mechanical support 74 (in particular the PCB 76 in the preferred embodiment) includes at least one recess 83 formed in a surface 85 of the mechanical support 74 for receiving a contact pin 52 (FIG. 2). In the preferred embodiment, each recess 83 is counter-drilled, as shown by FIG. 5C. Therefore, at least a portion of each recess 83 is tapered such that a width (i.e., distance in the x-direction) of the recess 83 decreases in the y-direction. Consequently, the mechanical support 74 includes a slanted wall 87 that defines a recess 83 and that slants away from the surface 85 and toward the middle of the recess 83, as shown by FIG. 5C.

A portion of the wall 87 is preferably conductive and electrically coupled to a connection 79 so that the wall 87 may be used to communicate electrical signals between the connection 79 and a contact pin 52 (FIG. 2), when the contact pin 52 is engaged with the wall 87. In the preferred embodiment, the wall 87 is formed by a conductive pad 81, which has been plated or otherwise coupled to the PCB 76, as shown by FIGS. 5B and 5C.

Figure 6:
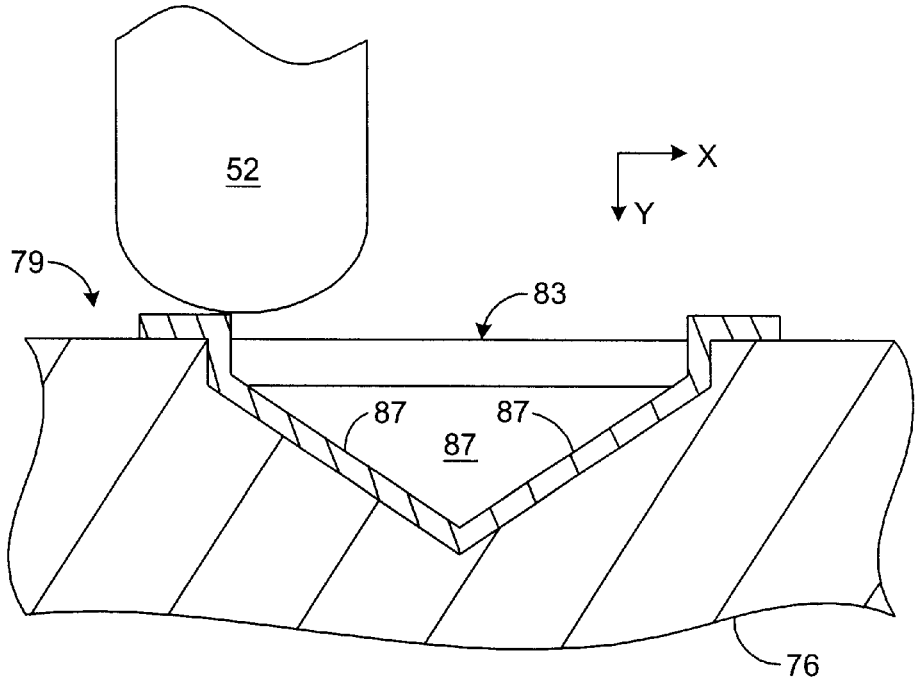
FIG. 6 is a cross-sectional diagram illustrating the recess of FIG. 5C when a contact pin is engaged with the outer surface of the mechanical support.
Figure 7:
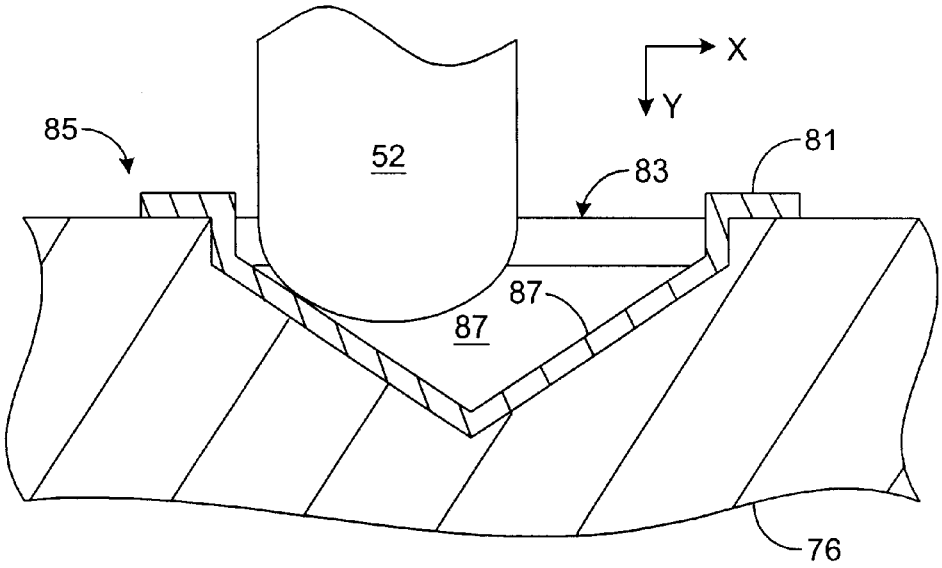
FIG. 7 is a cross-sectional diagram illustrating the recess of FIG. 6 when the contact pin is passing through the recess and is engaged with a slanted wall defining the recess.

The recesses 83 are positioned on the surface 85 of the mechanical support such that each recess 83 receives a respective contact pin 52 (FIG. 2), as the male connector 13 is engaged with the female connector 11. It is not likely that a contact pin 52 will be precisely aligned with the center of its respective recess 83 as the male connector 13 is engaged with the female connector 11, as shown by FIG. 6, and the contact pin 52 either engages the slanted wall 87 of the recess 83 directly or first engages the outer surface 85 of the mechanical support 74, depending on how closely the contact pin 52 is aligned with the center of the recess 83. Since the contact pin 52 is spring loaded, the contact pin 52 includes some flexibility of movement, and as long the center of the contact pin 52 is aligned with a portion of the recess 83, the contact pin 52 should be forced toward and eventually received by recess 83 as the contact pin 52 is pressed in the y-direction. Therefore, even when the contact pin 52 first engages the outer surface 85 of the mechanical support 74, as shown by FIG. 6, the contact pin 52 should eventually be received by recess 83 and engage the slanted wall 87, as shown by FIG. 7.

Figure 8:
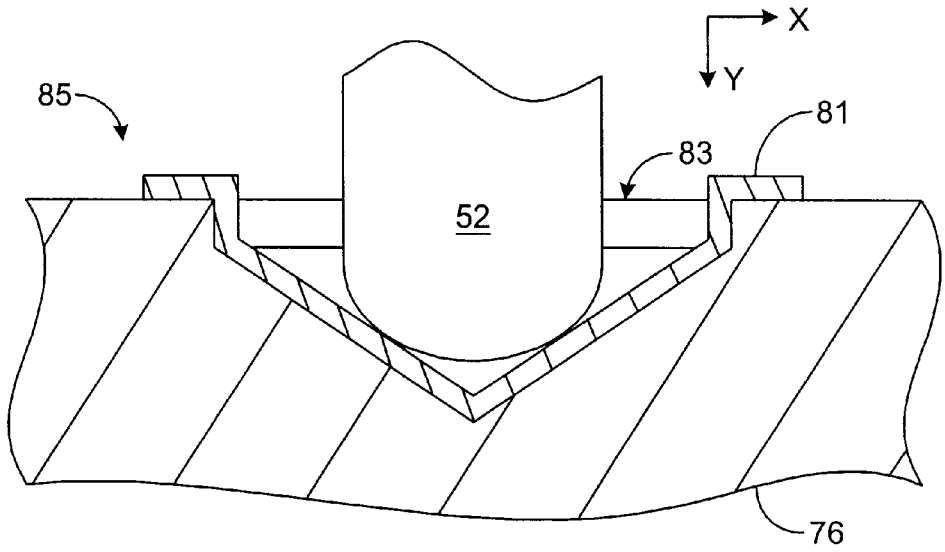
FIG. 8 is a cross-sectional diagram illustrating the recess of FIG. 7 when the contact pin is aligned with the center of the recess and is engaged with opposite sides of the wall defining the recess.

As the contact pin 52 is pressed against the wall 87 with a force sufficient to overcome the friction between the wall 87 and the pin 52, the contact pin 52 moves (i.e., slides) along the surface of the wall 87 toward the center of the recess 83. In other words, the contact pin 52 is guided by the wall 87 toward the center of the recess 83. Eventually, the pin 52 should engage an opposite portion of the wall 87, as shown by FIG. 8, and be secured in the x-direction by the wall 87.

In operation, a user engages the male connector 13 with the female connector 11 in an orientation such that each contact pin 52 is received by a respective recess 83. At this point, the contact pins 52 are not necessarily aligned with the centers of their respective recesses 83. As the assemblies 42 and 45 are pushed together by the user, each contact pin 52 engages a slanted wall 87 of a respective one of the tapered recesses 83. The slanted wall 87 guides the contact pin 52 toward the center of the recess 83 as the assemblies 42 and 45 are further pushed together.

Once the connectors 11 and 13 are locked together, each contact pin 52 should be engaged with a wall 87 of a respective recess 83 and, therefore, should be electrically coupled to a conductive connection 79 (FIG. 5B). Because wall 87 is slanted toward the middle of recess 83 in a direction away from surface 85, the wall 87 tends to resist movement by the pin 52 away from the middle of recess 83. Accordingly, it is not likely that small movements by the assembly 42 and/or 45 in a direction parallel with the surface 85 are likely to cause the pins 52 to become separated from the wall 87 and, therefore, to become electrically separated from their respective connections 79. Consequently, for electrical separation to occur, it is likely that the pins 52 will have to move parallel to the y-direction. However, because of the design of the engagement pins 17 and 19 and connector 13, inadvertent movements by the assembly 42 and, therefore, by the pins 52 in the y-direction are not likely to occur. This is especially true in embodiments in which the pins 52 are spring loaded, as described in U.S. Pat. No. 5,857,866. Consequently, once the pins 52 have been received by recesses 83 and the connectors 11 and 13 have been interlocked, it is likely that each pin 52 will have established and will maintain an electrical connection with the conductive portion of wall 87 and, therefore, with a respective conductive connection 79.

Although the present invention may be implemented to establish and maintain an electrical connection with a single contact pin 52, it should be noted that the present invention greatly simplifies the process of establishing and maintaining electrical connections with a plurality of contact pins 52. In this regard, the user needs to ensure that only one contact pin 52 is received by the pin's respective recess 83 as the user mates the male connector 13 with the female connector 11. Preferably, the user ensures that the contact pin 52 closest to the male connector 13 is received by its respective recess 83, although it is possible for the user to focus on one of the other contact pins 52 instead. Once one of the contact pins 52 is received by its respective recess 83, the remaining contact pins 52 should be automatically received by their respective recesses 83, since the pattern of the recesses 83 should correspond to the pattern of the contact pins 52. Therefore, electrical connections with the remaining contact pins 52 are automatically established and maintained.

Figure 9:
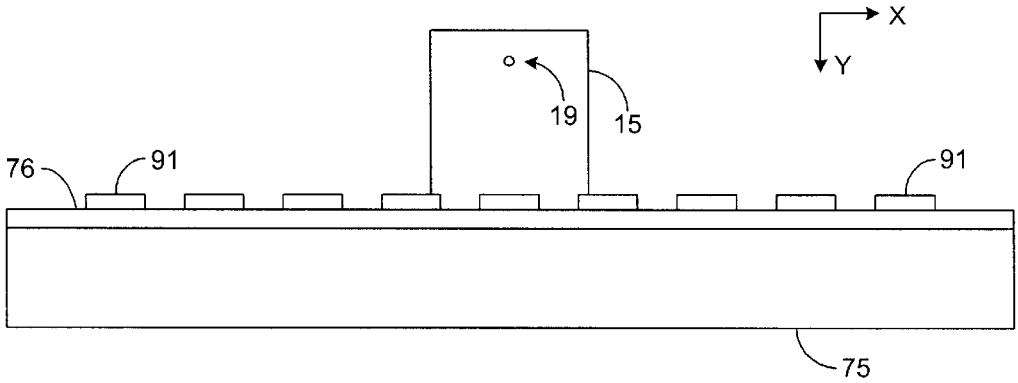
FIG. 9 is a diagram illustrating a bottom view of another embodiment of a female connector assembly in accordance with the present invention.

It should be noted that it is not necessary for a portion of the slanted wall 87 to be conductive. For example, in an alternative embodiment, conductive pads 91 are formed on a non-recessed portion of the mechanical support 74, as shown by FIG. 9. Similar to the conductive pads 81 shown by FIG. 5B, the conductive pads 91 of FIG. 9 are preferably electrically coupled to conductive connections 79 that are routed to other devices (not shown). For example, similar to the embodiment shown by FIG. 5B, the conductive pads 91 and connections 79 may be formed on a PCB 76. In another example, the conductive pads 91 may be formed on a flexible printed circuit (not shown) that similar to the PCB 76, provides conductive connections 79 between the conductive pads 91 and other devices (not shown). Other designs for electrically connecting the pads 91 with other devices (not shown) may be employed without departing from the principles of the present invention.

Figure 10A:
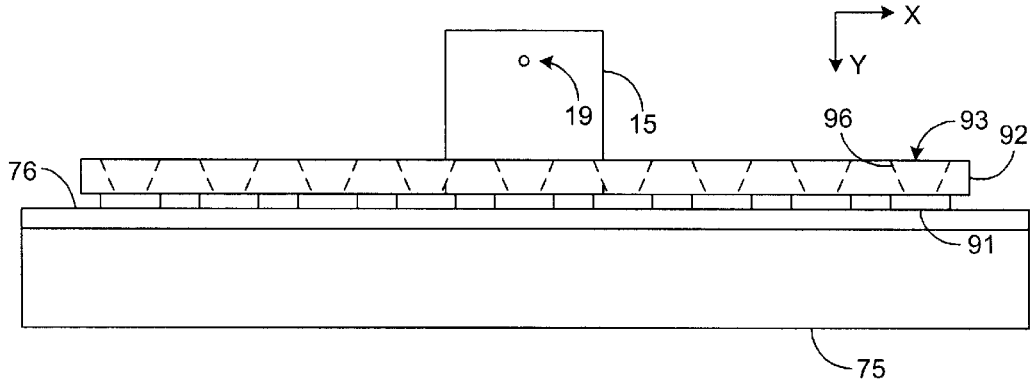
FIG. 10A is a diagram illustrating the bottom view of the female connector assembly of FIG. 9 when a cover with tapered recesses has been formed and included in the mechanical support.
Figure 10B:
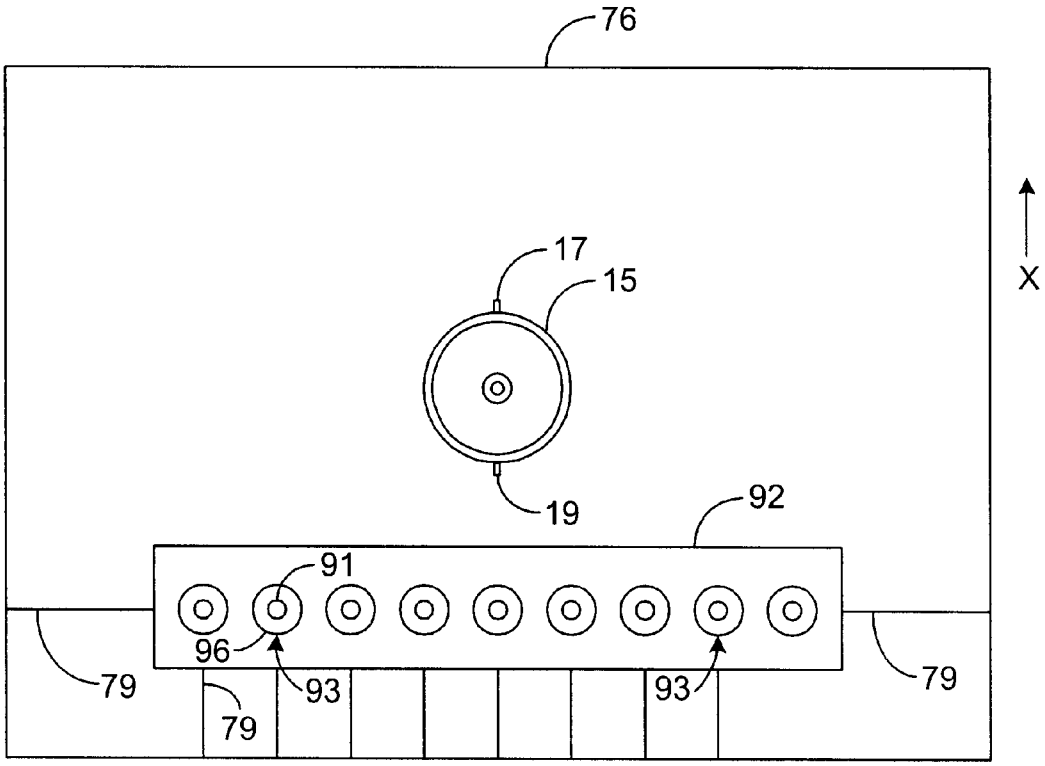
FIG. 10B is a top view of the female connector assembly of FIG. 10A.

Once conductive pads 91 have been formed, a cover 92 having tapered recesses 93 passing therethrough may be positioned over the pads 91, as shown by FIGS. 10A and 10B. In FIG. 10A, base 75, PCB 76, pads 91, and cover 92 collectively form the mechanical support 74, and each of the pads 91 is exposed by a respective recess 93. Therefore, the surface of each pad 91 exposed by the pad's respective recess 93 forms a wall of the recess 93. As previously described for the preferred embodiment, each of the contact pins 52 is received by a respective recess 93 and engages a slanted wall 96 defining the recess 93 as the male connector 13 is mated with the female connector 11. The slanted wall 96 guides the contact pin 52 toward the center of the recess 93, and eventually the contact pin 52 engages the conductive pad 91 exposed by the recess 93. Therefore, an electrical connection between the conductive pad 91 and contact pin 52 is easily established and maintained.

It should be noted that although the present invention has been described in the context of BNC connectors 11 and 13, other types of connectors may be used to interlock or otherwise interconnect assemblies 42 and 45. Furthermore, it should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of the present invention.

Now, therefore, the following is claimed:

1. A system for establishing and maintaining electrical connections between connector assemblies, comprising:

a mechanical support having a tapered recess and a wall, said wall defining said recess;

a conductive connection electrically coupled to said wall;

a first Bayonet Neil-Concelman (BNC) connector coupled to said mechanical support; and a BNC connector assembly, said BNC connector assembly including a second BNC connector and a contact pin, said contact pin having a rounded tip, said contact pin located at a fixed distance from said second BNC connector, wherein said recess is positioned relative to said first BNC connector such that said contact pin is received by said tapered recess and engaged within said tapered recess when said first BNC connector is connected to said second BNC connector, and wherein said wall is slanted towards a center of said tapered recess so that said wall tends to resist movement by said contact pin away from said center of said tapered recess and contact between the tapered recess and the rounded tip of the contact pin ensure adequate conductive contact between the contact pin and the walls of the tapered recess.

2. The system of claim 1, wherein said mechanical support further comprises a conductive pad, said conductive pad exposed by said tapered recess.

3. The system of claim 1, wherein said mechanical support includes a printed circuit board and wherein said recess is formed within said printed circuit board.

4. The system of claim 1, wherein said mechanical support includes a second tapered recess and a second wall, wherein said second wall defines said second tapered recess, and wherein said system further comprises:

a second conductive connection electrically coupled to said second wall.

5. The system of claim 1, wherein said mechanical support includes a second tapered recess and wherein said second BNC connector includes a second contact pin, said second contact pin located at a fixed distance from said second BNC connector, said second recess positioned relative to said second BNC connector such that said second contact pin is received by said second tapered recess when said first BNC connector is connected to said second BNC connector.

6. The system of claim 1, wherein said wall guides said contact pin toward said center of said recess when said contact pin engages is pressed against said wall.

7. A system for establishing and maintaining electrical connections between connector assemblies, comprising:

a mechanical support having a tapered recess defined by walls;

a first connector coupled to said mechanical support;

a connector assembly having a second connector and a contact pin, said second connector interconnected with said first connector, said contact pin having a rounded tip, said contact pin passing through said recess and engaged with said mechanical support; and a conductive connection coupled to said mechanical support and electrically coupled to said contact pin, wherein said walls are slanted towards a center of said tapered recess so that said walls and contact between the walls of the tapered recess and the rounded tip of the contact pin provide resistance against movement by said contact pin away from said center of said tapered recess and ensure adequate conductive contact between the contact pin and the walls of the tapered recess.

8. The system of claim 7, wherein said first connector and said second connector are Bayonet Niel-Concelman connectors.

9. The system of claim 7, wherein said mechanical support includes a conductive pad coupled to said contact pin and exposed by said recess.

10. The system of claim 7, wherein said mechanical support includes a printed circuit board and wherein said recess is formed within said printed circuit board.

11. A method for establishing and maintaining electrical connections between connector assemblies, comprising the steps of:

providing a first Bayonet Neil-Concelman (BNC) connector assembly, said first BNC connector assembly having a first BNC connector and a tapered recess, said tapered recess defined by walls that slant towards a center of said tapered recess;

providing a second BNC connector assembly, said second BNC connector assembly having a second BNC connector and a contact pin, said contact pin having a rounded tip; and connecting said first BNC connector assembly to said second BNC connector assembly, said connecting step further including the steps of:

(a) coupling said first BNC connector assembly to said second BNC connector;

(b) engaging said wall with said contact pin; and (c) sliding said contact pin along a surface of said wall, wherein the slanting of said walls towards said center of said tapered recess and contact between the walls of the tapered recess and the rounded tip of the contact pin provide resistance against movement by said contact pin away from said center of said tapered recess and ensure adequate conductive contact between the contact pin and the walls of the tapered recess.

12. A method of claim 11, wherein said sliding step further includes the step of guiding said contact pin toward said center of said recess.

13. The method of claim 11, further comprising the step of transmitting an electrical signal via said contact pin.

14. A method for establishing and maintaining electrical connections between connector assemblies, comprising the steps of:

providing a first connector assembly having a first electrical connector and a contact pin, said contact pin having a rounded tip;

providing a second connector assembly having a second electrical connector coupled to a mechanical support, said mechanical support having a tapered recess, said recess defined by walls of said mechanical support, wherein said walls slant towards a center of said recess;

interconnecting said first electrical connector with said second electrical connector;

passing said contact pin through said recess;

engaging said mechanical support with said contact pin; and sliding said contact pin along a surface of said wall, wherein the slanting of said walls towards the center of said tapered recess and contact between the tapered recess wall and the rounded tip of the contact pin provide resistance against movement by said contact pin away from said center of said tapered recess and ensure adequate conductive contact between the contact pin and the tapered recess wall.

15. A method of claim 14, wherein said sliding step further includes the step of guiding said contact pin toward said center of said recess.

16. The method of claim 14, wherein said first electrical connector and said second electrical connector are Bayonet Neil-Concelman (BNC) connectors.

17. A system for establishing and maintaining electrical connections between connector assemblies, comprising:

a mechanical support having a tapered recess and walls, said walls defining said tapered recess;

a Bayonet Neil-Concelman (BNC) connector coupled to said mechanical support; and a second BNC connector assembly, said second BNC connector assembly including a second connector and a contact pin, said contact pin having a rounded tip, wherein said walls are slanted towards a center of said tapered recess so that said walls and contact between the walls of the tapered recess and the rounded tip of the contact pin provide resistance against movement by said contact pin away from said center of said tapered recess and ensure adequate conductive contact between the contact pin and the walls of the tapered recess.

18. A method for establishing and maintaining electrical connections between connector assemblies, comprising the steps of:

providing a first connector assembly, said first connector assembly having a first connector, a plurality of tapered recesses, and a plurality of walls, each of said tapered recesses being defined by respective walls of said plurality of walls, the walls defining each respective recess slanting towards a center of the respective recess;

providing a second connector assembly, said second connector assembly having a second connector and a plurality of contact pins, said contact pin having a rounded tip, said contact pins arranged such that each of said contact pins is substantially aligned with one of said tapered recesses when said first connector is aligned with said second connector and when one of said contact pins is aligned with a corresponding one of said tapered recesses;

connecting said first connector assembly to said second connector assembly, said connecting step including the steps of:

(a) ensuring that said first connector is aligned with said second connector;

(b) ensuring that said one contact pin is aligned with said corresponding one of said tapered recesses; and (c) pressing said connector assemblies together during said ensuring steps such that said first connector engages said second connector and such that said one contact pin passes through said corresponding one of said tapered recesses, wherein another of said contact pins is automatically aligned with and passes through another of said tapered recesses during said pressing step, wherein the slanting of the walls towards the centers of said tapered recesses and contact between the walls of the tapered recess and the rounded tip of the contact pin provide resistance against movement by said contact pin away within the respective recesses and ensure adequate conductive contact between the contact pins and the walls of the respective recesses.

19. The method of claim 18, wherein said connecting step further includes the step of:

(d) fixedly securing said first connector to said second connector.

20. The method of claim 18, wherein said first and second connectors are Bayonet Neil-Concelman (BNC) connectors.

* * * * *